US008093840B1

(12) United States Patent
Douglas

(10) Patent No.: US 8,093,840 B1
(45) Date of Patent: Jan. 10, 2012

(54) USE OF OFF-AXIS INJECTION AS AN ALTERNATIVE TO GEOMETRICALLY MERGING BEAMS IN AN ENERGY-RECOVERING LINAC

(75) Inventor: David R. Douglas, York County, VA (US)

(73) Assignee: Jefferson Science Associates, LLC, Newport News, VA (US)

( * ) Notice: Subject to any disclaimer, the term of this patent is extended or adjusted under 35 U.S.C. 154(b) by 595 days.

(21) Appl. No.: 12/316,059

(22) Filed: Dec. 9, 2008

(51) Int. Cl.
*H05H 9/00* (2006.01)

(52) U.S. Cl. ..... 315/505; 315/507

(58) Field of Classification Search ..... 315/500–507
See application file for complete search history.

(56) References Cited

U.S. PATENT DOCUMENTS

| | | | | |
|---|---|---|---|---|
| 5,805,620 | A * | 9/1998 | Liu et al. | 372/2 |
| 5,811,943 | A * | 9/1998 | Mishin et al. | 315/505 |
| 6,724,782 | B2 * | 4/2004 | Hartemann et al. | 372/5 |
| 7,166,973 | B1 * | 1/2007 | Douglas et al. | 315/500 |
| 2009/0140672 | A1 * | 6/2009 | Gall et al. | 315/502 |

* cited by examiner

*Primary Examiner* — Tung X Le

(57) ABSTRACT

A method of using off-axis particle beam injection in energy-recovering linear accelerators that increases operational efficiency while eliminating the need to merge the high energy re-circulating beam with an injected low energy beam. In this arrangement, the high energy re-circulating beam and the low energy beam are manipulated such that they are within a predetermined distance from one another and then the two immerged beams are injected into the linac and propagated through the system. The configuration permits injection without geometric beam merging as well as decelerated beam extraction without the use of typical beamline elements.

9 Claims, 2 Drawing Sheets

USE OF OFF-AXIS INJECTION AS AN ALTERNATIVE TO GEOMETRICALLY MERGING BEAMS IN AN ENERGY-RECOVERING LINAC

The United States of America may have certain rights to this invention under Management and Operating Contract No. DE-ACO5-84ER 40150 from the Department of Energy.

FIELD OF THE INVENTION

The present invention relates to the operation of particle beam accelerators and more particularly, a more efficient method of energy-recovering linac operation without actual geometric merging of the particle beams in the system.

BACKGROUND OF THE INVENTION

As is well known in the art, the use of energy recovery in linear particle accelerators, also known as linacs, allows acceleration of particles to energies equivalent to that found in conventional cyclic particle accelerators while improving beam quality and greatly reducing the power required to initiate and maintain high beam currents.

An energy-recovering linac (ERL) relies upon the same radio frequency (RF) cavities that are used to accelerate a particle beam to recapture and re-use the beam energy. In a typical system, electrons are (1) injected into the linac; (2) accelerated in one or more RF cavities; (3) propagated through a return loop; (4) decelerated by the same RF cavities; and (4) ejected or dumped from the system. During the deceleration process energy is transferred to the newly injected low energy beam. The kinetic energy obtained from the decelerated particles is therefore used to accelerate the electrons in the first pass beam.

In order to effectively accomplish the aforementioned energy recovery, the injected particle beam has traditionally been merged onto the axis of the linac. However, such merging of the injected beam onto a linac axis involves bending the beam, which is known to lead to space-charge induced beam quality degradation. Further, additional significant and space intensive steering of the re-circulated beam is likely required in order to adequately merge the beams.

An alternative merging system involves the use of a radio frequency deflection system to combine the spatial trajectories of the various beam passes. This approach is also problematic as such separation/combination can induce transverse emittance degradation due to variations in the deflecting field across the electron bunch length. A variation of such a system would rely upon deflecting the high energy beam and leaving the low energy beam un-manipulated. Once again, this variation generally requires an excessive amount of power in order to deflect the high energy beam, particularly at high currents. Also, such systems often require the use of septum magnets which can amplify halo effects. Adequate control of beam halo is essential as the beam charge per bunch and current increase. Further, this type of system is generally space intensive and requires a larger ERL footprint.

Consequently, a need exists for an efficient, power and space saving method for effectively injecting and propagating beams in an ERL that overcomes the drawbacks that exist with the typical methods of merging the beams on a linac axis.

OBJECT OF THE INVENTION

It is an object of the invention to provide a method for more efficiently operating an ERL and thereby accomplishing one or more of the following: (1) reducing total power requirements, (2) reducing space requirements and (3) improving beam quality.

SUMMARY OF THE INVENTION

The present invention describes a method by which off-axis injection is used as an alternative to geometrically merging high energy and low energy beams in an ERL. The method discloses an exemplary beam separation of approximately 3 inches (7.62 cm) when used in conjunction with a 750 MHz accelerating cryomodule for the acceleration of 7 MeV beam to 100 MeV and the recovery of a 100 MeV beam to 7 MeV.

DESCRIPTION OF THE DRAWINGS

FIG. 1 as a whole shows the orbits for steered injected and re-injected particle beams in a 93 MeV 750 MHz linac.

DETAILED DESCRIPTION

The method disclosed herein uses off-axis injection of the particle beams in an ERL as an alternative to geometrically merging the beams.

The use of a circular accelerator, such as a cyclotron or betatron, results in a beam with a closed orbit in which the particles traverse a generally circular path. All electromagnetically active elements have symmetries which result in the creation of an ideal plane for the circulating beam. In order to maximize the performance of the accelerator, the beam is best propagated in this ideal or most efficient orbit. Therefore, it is advantageous to line up the beam in the axis of this plane so as to facilitate beam travel while minimizing beam oscillation. Due to the fact that the beam in a synchrotron or betatron circulates repeatedly, it is vitally important to obtain and maintain ideal beam alignment. If the beam is not perfectly aligned, even minute errors will affect beam path since their effect will be increased with each pass.

Consequently, it has been generally accepted that in an ERL the high energy re-circulating beam and injected low energy beam must be similarly aligned in this ideal position collinear with the linac axis. However, the instant invention, discloses a method for introducing and propagating high and low energy beams that does not rely upon merging the beams onto this ideal linac axis. The beams are manipulated so that they are in proximity to one another and then both beams are injected into the linac, propagating them through the system. Although the beams are in proximity, they are never merged with one another, i.e., they are never made co-axial or co-linear.

Prior to injection, the beams are independently manipulated through the creation and use of magnetic fields as is well known in the art. Unlike the more frequently used techniques, however, the low energy beam that is injected into the system is only minimally manipulated prior to injection into the linac. The re-circulating high energy beam is bent to a greater degree prior to injection. Beam manipulation within the linac itself is achieved through the use of RF fields within the cavities instead of through the use of magnets. Due to the differences in beam energy, the RF cavity has a much greater steering effect on lower energy beams. RF focusing can therefore be used to provide steerage of the low energy beam independent of the high energy beam.

Figure 1A:
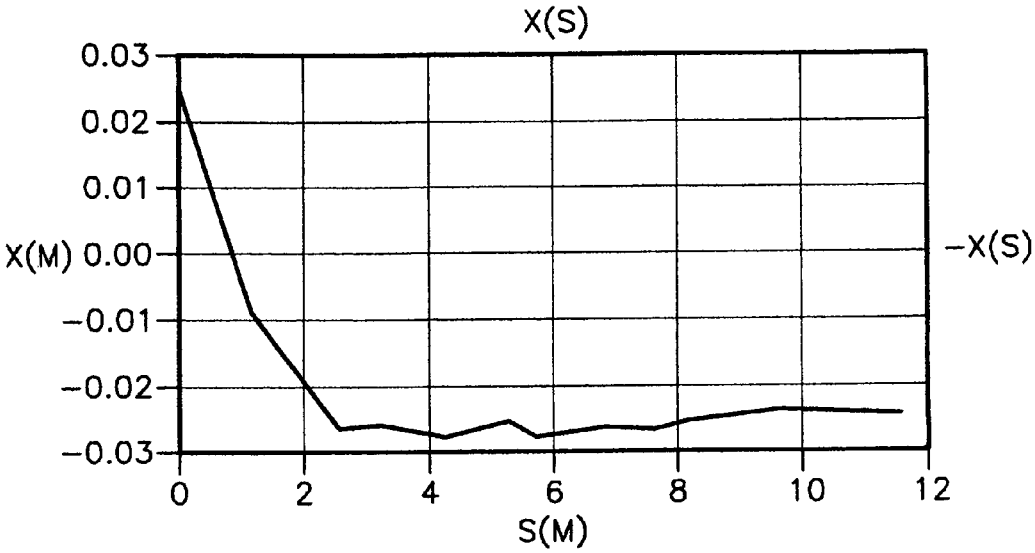
FIG. 1*a* reflects the orbits with the low energy beam injected to the outside of the machine.
Figure 1B:
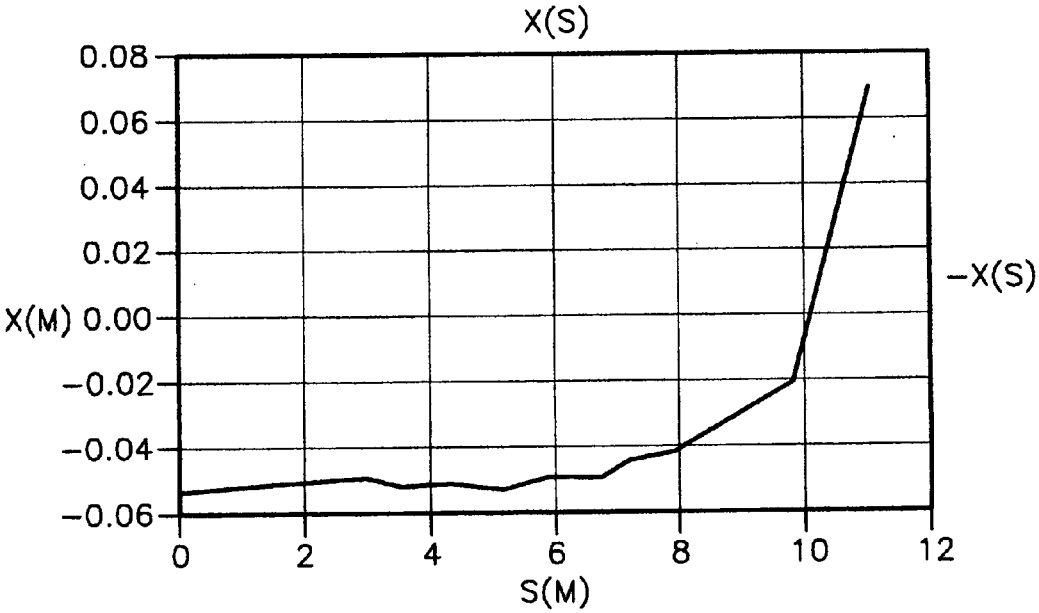
FIG. 1*b* reflects the orbits with the re-injected high energy beam biased to the inside of the machine.

FIG. 1 shows the orbits of the high and low energy beams relative to the axis of a 93 MeV 750 MHz linac in one potential embodiment of the method. Specifically, FIG. 1*a* reflects the orbit for the acceleration of a 7 MeV beam to 100 MeV when injected to the outside of the device. FIG. 1*b* reflects the orbit for the recovery to 7 MeV of a 100 MeV beam biased to the inside of the device. The figures show a physical depiction of the orbit when the disclosed method is implemented under the specified parameters.

Figure 2:
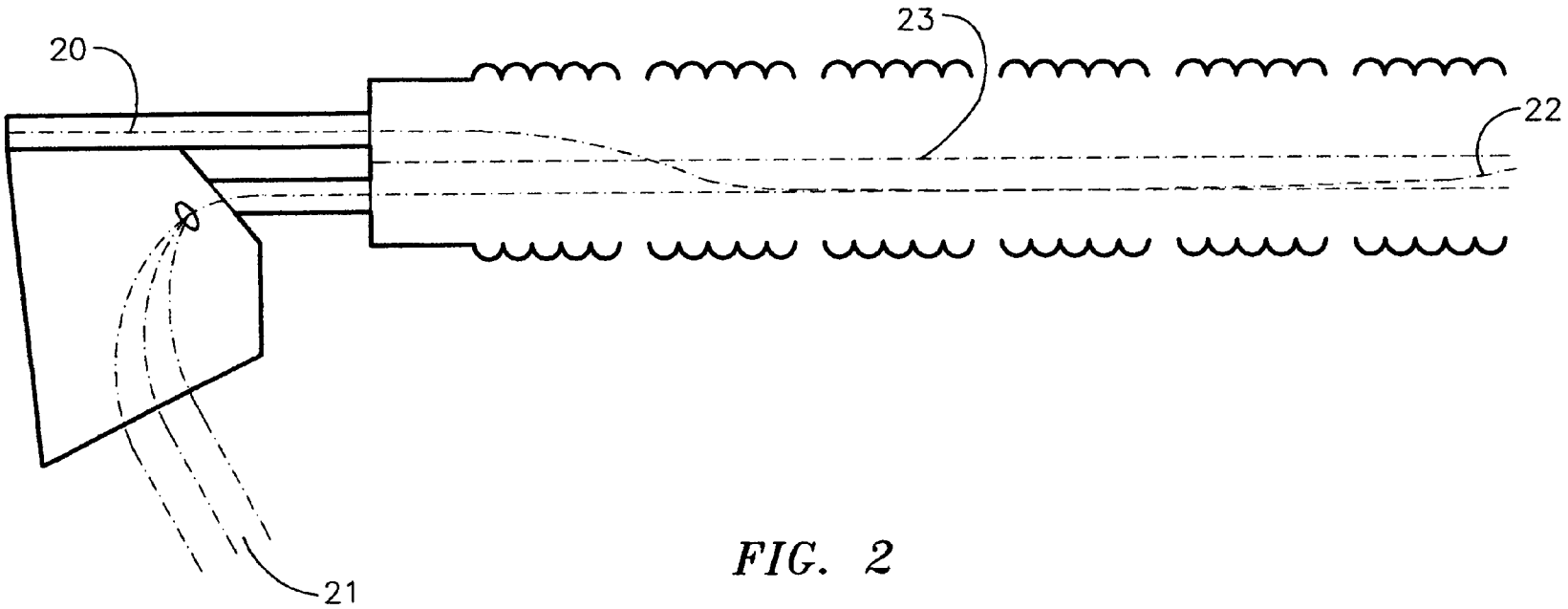
FIG. 2 is an illustration showing a typical configuration of an unmerged system.

This disclosed method is of particular value in an ERL since, unlike a synchrotron or betatron, an ERL does not rely upon a closed orbit system and is not necessary phase stable. Further, the physical structure of the ERL is further conducive to an unmerged system as linacs for superconducting radio frequency ERLs generally have a large acceptance. In the embodiment disclosed herein, the linac would have a bore of approximately 6 inches (15.24 cm). FIG. 2 shows one possible configuration for an unmerged system as disclosed. Once again, the beams are separated by approximately 3 inches (7.62 cm), well within the bore of the linac.

In this embodiment of an unmerged system, as reflected in FIGS. 1 and 2, the beams (20, 21) are separated by approximately 3 inches (7.62 cm) at the time they are injected into the linac. However, even larger separations could be used in lower frequency systems. The beam offset from the linac axis (23), and thus the total amount of separation, reflected in this embodiment is generally adequate to manage the geometry, i.e. trajectory and beam size, of the two beams under the disclosed system parameters. This amount of separation would also permit adequate focusing on either beam separate from that on the other, e.g., through the use of Collins or septum quadrupoles. It will be recognized by those skilled in the art that the orbits reflected in the foregoing figures, and therefore the total beam separation and accompanying displacement from the linac axis, may vary depending on the frequency of the system or other similar variables.

It will also be noted that the injected beam can be matched to the linac acceptance at more than one point prior to injection. As seen in FIG. 2, the beams can be manipulated at a point almost immediately preceding injection. Alternatively, the injected beam could be matched to the linac acceptance by a telescope upstream of the final recirculator dipole, and the final recirculation arc could be designed to deliver an appropriately matched beam for energy recovery using only matching telescopes upstream of the arc. This would be determined as a result of a detailed optimization of the beam optics solution in a specific design.

The use of unmerged injection/re-injection geometry not only allows injection without merging but it also allows extraction without the use of common beamline elements. After traversing the linac, the resulting separation of the two beams at the end of the linac simplifies the beam extraction process. As seen in FIG. 2, after traversing the length of the linac, the recovered beam (22) is angled away from the linac axis (23) toward the exterior of the system.

The use of the non-merged system provides additional substantial benefits over the conventional techniques involving beam merging. Any system which bends the injected low energy beam results in performance degradation. The non-merged system avoids bending the injected beam and thus directly reduces this potential degradation. The use of the non-merged system also provides considerable injector design and acceleration operational flexibility. One could, for example, generate multiple bunch trains with differing properties and use the associated timing or energy differentials so created to select the destination of the bunch train later in the acceleration cycle. Similarly, the absence of beam bending would allow variation in the injector energy without significant impact on the ERL as a whole. This may be advantageous in machine operation or diagnosis. Finally, the equipment required to implement such a non-merged system permit an extremely compact machine footprint which results in considerable space savings.

While the invention has been described in reference to certain preferred embodiments, it will be readily apparent to one of ordinary skill in the art that certain modifications or variations may be made to the system without departing from the scope of invention claimed below and described in the foregoing specification.

What is claimed is:

1. A method of off-axis beam injection in a linear particle accelerator which is operating with a higher energy re-circulating particle beam and a lower energy injected particle beam, comprising:

determining a maximal displacement from the linear particle accelerator axis for each said higher energy particle beam and said lower energy particle beam such that said displacement results in a separation between said higher energy beam and lower energy beam;

matching said higher energy particle beam and said lower energy particle beam to the acceptance of said linear particle accelerator based upon the determined maximal displacement through the use of a plurality of magnetic fields;

injecting said particle beams into the linear particle accelerator; and steering said lower energy particle beam through the use of radio frequency focusing.

2. A method of manipulating particle beams in an energy recovering linear accelerator, which includes a higher energy beam and a lower energy beam in its operation, comprising the steps of:

orienting the higher energy beam and the lower energy beam to the acceptance of the linear accelerator;

propagating both of said beams into one or more accelerator cavities of said linear accelerator; and steering said lower energy beam independent of said higher energy beam within said one or more accelerator cavities through the use of radio frequency focusing.

3. The method of claim 2 wherein said orienting further comprises orienting said higher energy beam and said lower energy beam to the acceptance of the linear accelerator such that the injection trajectory of said lower energy injected beam is substantially maintained.

4. The method of claim 2 wherein said orienting results in a separation between said higher energy beam and said lower energy beam.

5. The method of claim 2 wherein said orienting occurs at a location in proximity to injection into said one or more accelerator cavities.

6. The method of claim 2 wherein said orienting occurs at a location before said particle beams pass through a final re-circulating dipole.

7. The method of claim 2 wherein said beams are not positioned co-axially at such time that said beams pass into the first of one or more accelerator cavities.

8. A method of injecting particle beams into an energy recovering linear accelerator, which includes in its operation a first beam and an injected second beam, said first beam initially having greater energy than said second beam, comprising:

orienting said first beam and said second beam to the acceptance of the linear accelerator such that the injection trajectory of said injected second beam is substantially maintained and separation between said beams exists at the time said beams pass through said acceptance;

propagating both of said beams into one or more accelerator cavities of said linear accelerator;

steering at least one of said beams independent of the other said beam through the use of radio frequency focusing such that separation between said beams exists after said beams have traversed the length of said one or more accelerator cavities; and transferring energy from said first beam to said second beam.

9. The method of claim 8 wherein steering said first beam results in said first beam being in such a position and moving in such direction so as to facilitate removal of said first beam and further comprising extracting said first beam from said energy recovering linear accelerator.

* * * * *